United States Patent [19]

Braverman et al.

[11] 4,399,626

[45] Aug. 23, 1983

[54] PHOTO DISPLAY DEVICE

[76] Inventors: Mel Braverman, 11 St. Andrews La., Glen Cove, N.Y. 11542; Joseph Lazar, 102-03 65th Rd., Forest Hills, N.Y. 11375

[21] Appl. No.: 230,534

[22] Filed: Feb. 2, 1981

[51] Int. Cl.[3] ..... G09F 19/00

[52] U.S. Cl. ..... 40/530; 40/379

[58] Field of Search ..... 40/379, 530, 119, 124.2, 40/593

[56] References Cited

U.S. PATENT DOCUMENTS 1,279,539 9/1918 Haggerty ..... 40/598

3,387,395 6/1968 Merritt et al. ..... 40/530

FOREIGN PATENT DOCUMENTS 918144 9/1954 Fed. Rep. of Germany ..... 40/119

37303 8/1906 Switzerland ..... 40/124.2

*Primary Examiner*—Gene Mancene

*Assistant Examiner*—Wenceslao J. Contreras

[57] ABSTRACT

A display device including a base, to which an upright standard is mounted. A display frame is rotatably mounted on the upright standard to permit rotation of the display frame about a vertical axis. Display support rods are mounted on the display frame for holding multiple groups of display items, such as photographs and the like. By rotation of the display frame, a selected group of the display items may be brought to view. The display support rods are constructed to permit selected display items to be flipped upwardly to expose the reverse side of the display item being flipped upwardly as well as the front side of the display item next behind the display item being flipped upwardly.

9 Claims, 8 Drawing Figures

PHOTO DISPLAY DEVICE

BACKGROUND OF INVENTION

This invention relates to display devices and in its narrow aspects has particular application to a device for displaying photographs and the like.

Display devices are known such as shown in U.S. Pat. No. 3,978,593 which include a stand including a base and an upright standard. A display rack is secured on the upright standard for displaying merchandise or other items. The display rack shown in U.S. Pat. No. 3,978,593 is rotatably mounted on the upright standard permitting rotation of the display rack about a vertical axis.

Another type of display rack is shown in U.S. Pat. No. 3,091,341. Here the display rack includes a horizontally extending rod mounted to an upright standard supported by a base. The items to be displayed are carried by the horizontally extending rod in a depending manner. This rod is mounted to the upright standard to permit rotation about a horizontal axis. As the rod is rotated, the items being displayed are flipped over exposing the item positioned behind the item just flipped over.

SUMMARY OF THE INVENTION

The present invention relates to a display device having a multi-panelled display frame. The display frame includes support rods having a horizontally positioned "U" configuration which extends away from the display frame for supporting groups of display items, which, for example, may by glassine envelopes which carry photographs and the like. The display frame is rotatably mounted to an upright standard supported by a base to permit rotation of the display frame about a vertical axis to bring a selected group of envelopes into view. Further, the envelopes may be flipped upwardly on the support rods to expose the reverse side of the envelope being flipped upwardly and the front side of the next envelope behind the envelope being flipped upwardly.

BRIEF DESCRIPTION OF THE DRAWINGS

In order that the invention may be clearly understood and readily carried into effect, a preferred embodiment will now be described, by way of example only, with reference to the accompanying drawings wherein.

DESCRIPTION OF PREFERRED EMBODIMENTS

Figure 1:
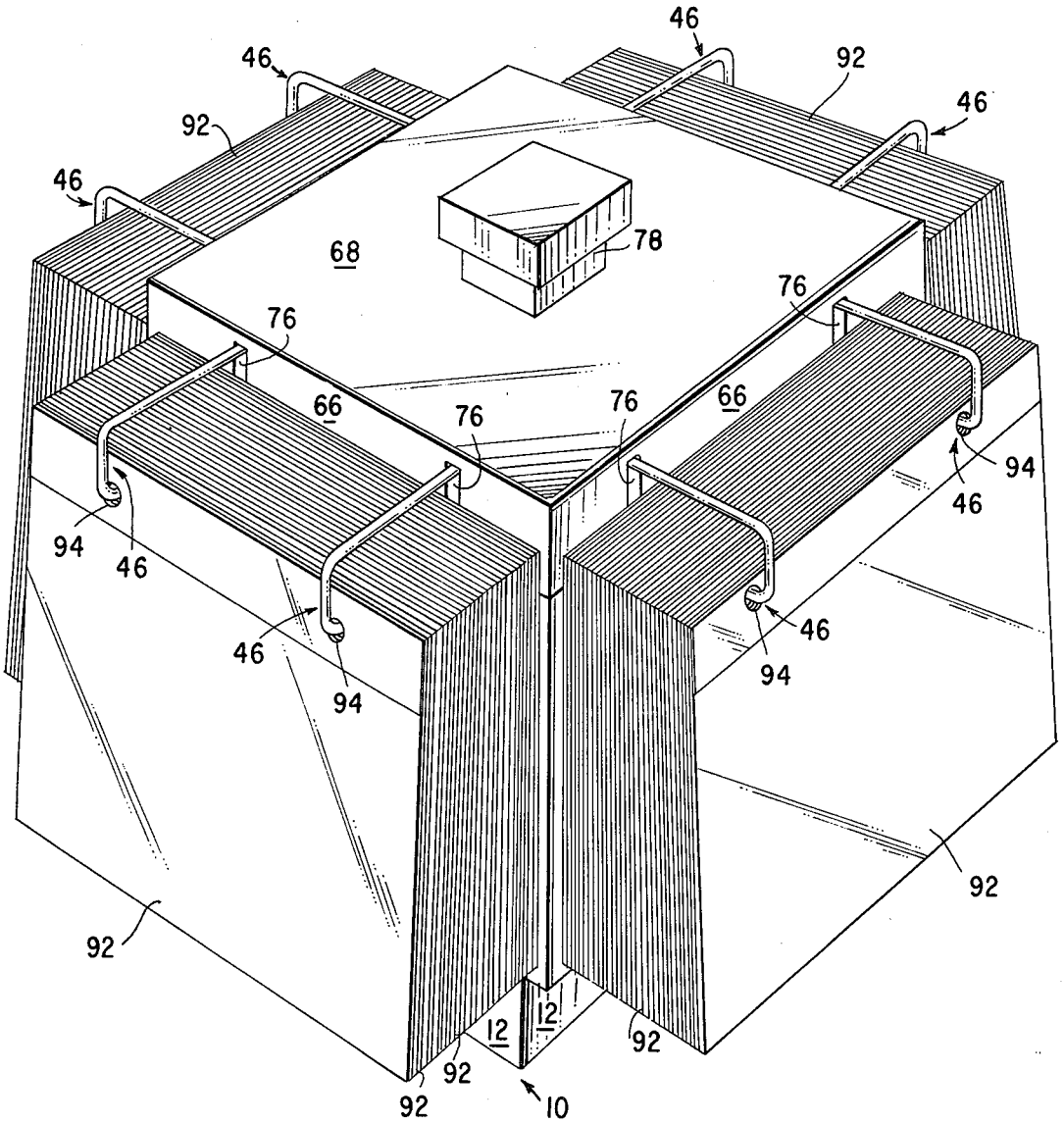
FIG. 1 is a perspective view of a display device according to the present invention.
Figure 2:
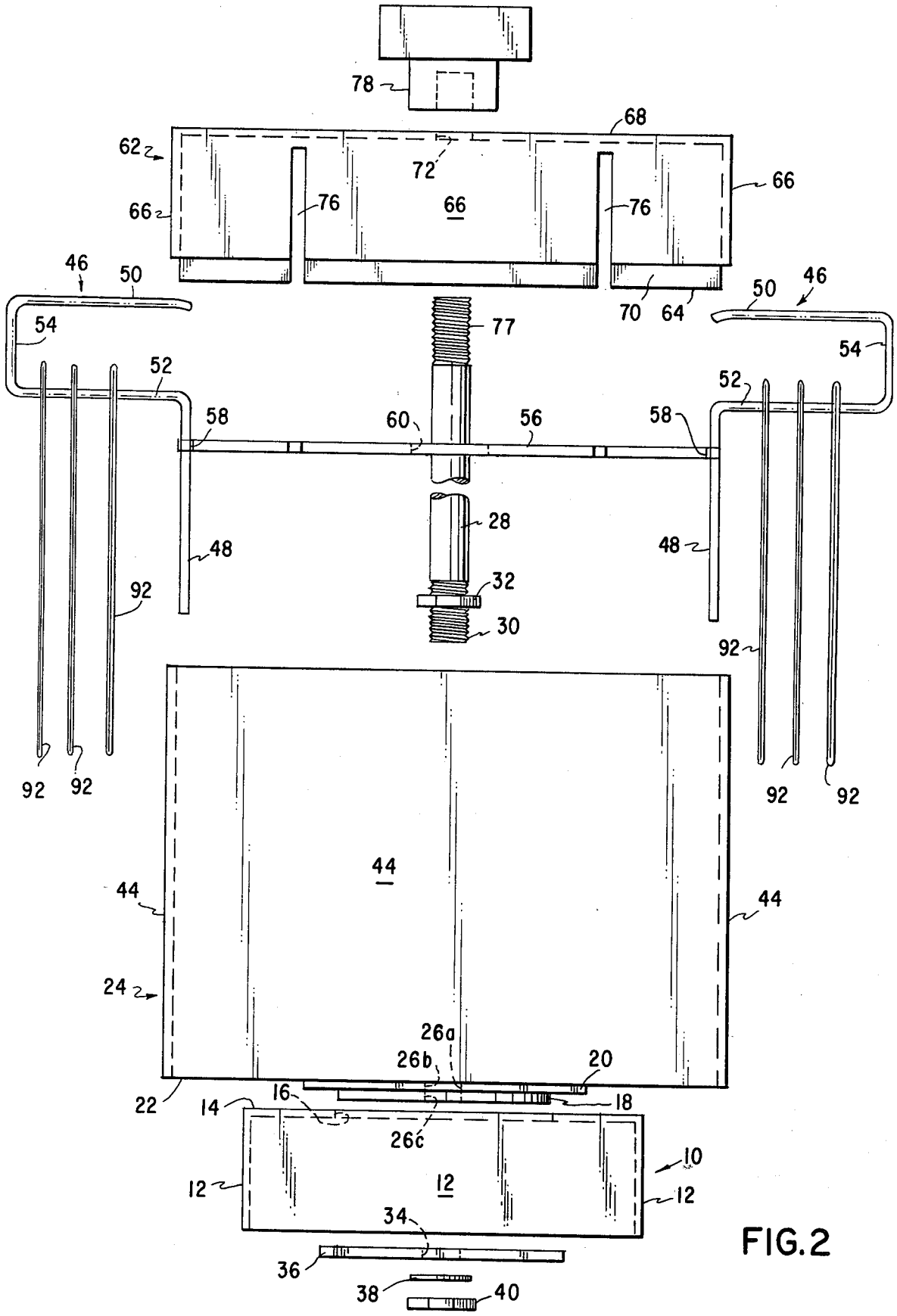
FIG. 2 is an exploded elevational view of one embodiment of the display device shown in FIG. 1 with the front support rods and depending items to be displayed removed for clarity.
Figure 3:
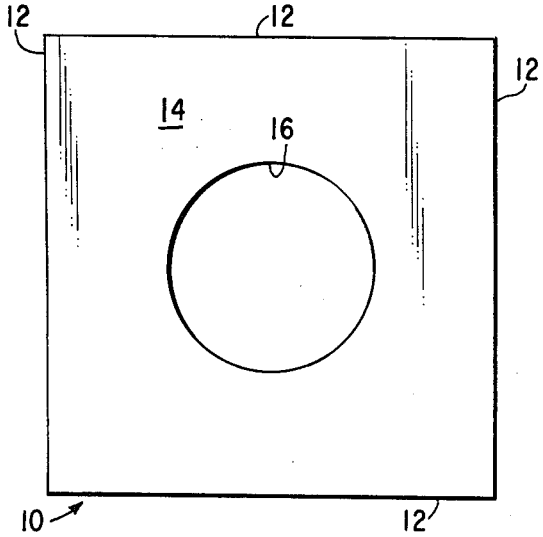
FIG. 3 is a top view of the base utilized in the display device of FIG. 1.

A display device is shown in FIGS. 1 and 2. This device includes a base 10 preferably constructed of an open bottom box having side walls 12 and a top wall 14. The top wall 14 includes a circular bore 16 in which a circular guide 18 is inserted during assembly of the display device. Circular guide 18 is fixedly attached to spacer 20 which in turn is fixedly attached to a bottom panel 22 of display frame 24. The bottom panel 22, the spacer 20 and the circular guide 18 have axially aligned bores **26*a*, 26*b* and 26*c* respectively for receiving an upright standard 28. The standard 28 has a threaded end 30 on which nut 32** is threadably mounted.

In assemblying the display device, the standard 28, on which nut 32 is mounted, is inserted in bores **26*a*, 26*b* and 26*c*. The bore 26*a* is sized to be of smaller diameter than nut 32 so that nut 32 rests on the upper surface of bottom panel 22. The portion of threaded end 30 of standard 28 extending beyond bore 26*c* is then inserted through bore 16 of base 10 and through a bore 34 of washer 36 and through lock washer 38. A nut 40 is then threaded on threaded end 30. The washer 36 is sized to have a larger diameter than bore 16; thus, the two nuts 32 and 40 on standard 28 hold the display frame 24 and the base 10 together on standard 28**.

The base 10 may be rotated with respect to display frame 24 about the vertical axis of standard 28 and the circular guide 18 in circular bore 16 maintains the display frame 24 and base 10 in an aligned position during such rotation.

Figure 4:
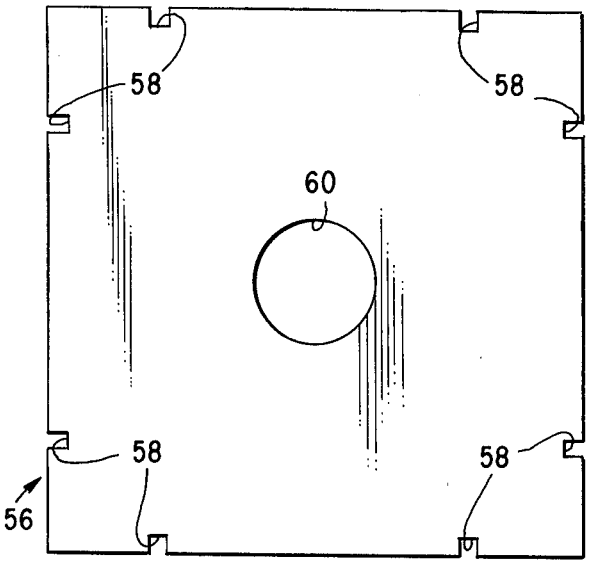
FIG. 4 is a top view of the support rod mounting panel utilized in the embodiment shown in FIG. 2.
Figure 5:
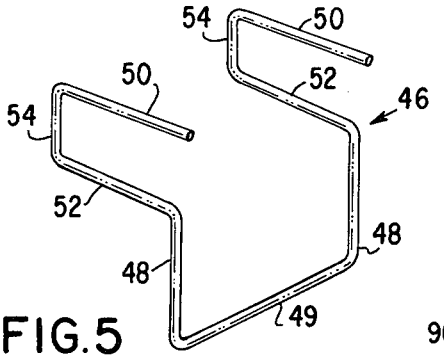
FIG. 5 is a perspective view of a support rod utilized in the embodiment shown in FIG. 1.

The display frame 24 has an open top 42 and side panels 44. In the embodiment shown in FIGS. 2, display item support rods 46 are mounted on the display frame 24. These support rods have a pair of generally "U" shaped upper portions from which legs 48 depend. The "U" shaped portions have an upper and lower generally horizontally positioned legs 50 and 52 with intermediate legs 54 as shown in FIGS. 2 and 5. The depending legs 48 are formed by bending an end portion of a leg 52 at approximately a right angle to the longitudinal axis of leg 52 as shown in FIGS. 2 and 5. The pair of generally "U" shaped upper portions are connected by a connecting leg 49 joined to each of the depending legs 48 of support rod 46. The support rods 46 are positioned with respect to display frame 24 so that the depending leg 48 abuts the inner surface of side panels 44 and the lower surface of leg 52 rests on the upper edge of side panels 44. These support rods 46 are held in place by a mounting panel 56 as shown in FIGS. 2 and 4. This mounting panel has notches 58 for receiving the depending legs 48 of support rods 46. The mounting panel 56 in the assembled display device holds the depending legs 48 in abutting relation with side panels 44 of display frame 24 whereby the "U" shaped portion of each of the support rods 46 is held in a generally horizontal position extending away from the display frame 24 as shown in FIG. 2. The mounting panel 56 further includes a bore 60 through which the upright standard 28 extends.

A top cover 62 is provided having an open bottom 64, side walls 66 and a top wall 68. The side walls 66 are provided with a recessed portion 70 along the bottom edge thereof so that when the top cover 62 is placed on display frame 24, the horizontal ledge formed by the recessed portion 70 of side walls 66 rests on the upper edge of side panels 44 and the vertical ledge formed by the recessed portion 70 of side walls 66 rests against the inner surface of side panels 44. The top wall 68 of top cover 62 is provided with a bore 72 through which upright standard 28 extends. The walls 66 further have slots 76 for receiving legs 50 and 52 of support rods 46 when the display device is assembled.

The upper end of standard 28 is provided with a threaded portion 77 and a decorative nut 78 is threaded on standard 28 to secure the top cover 62 to the display frame 24.

Figure 7:
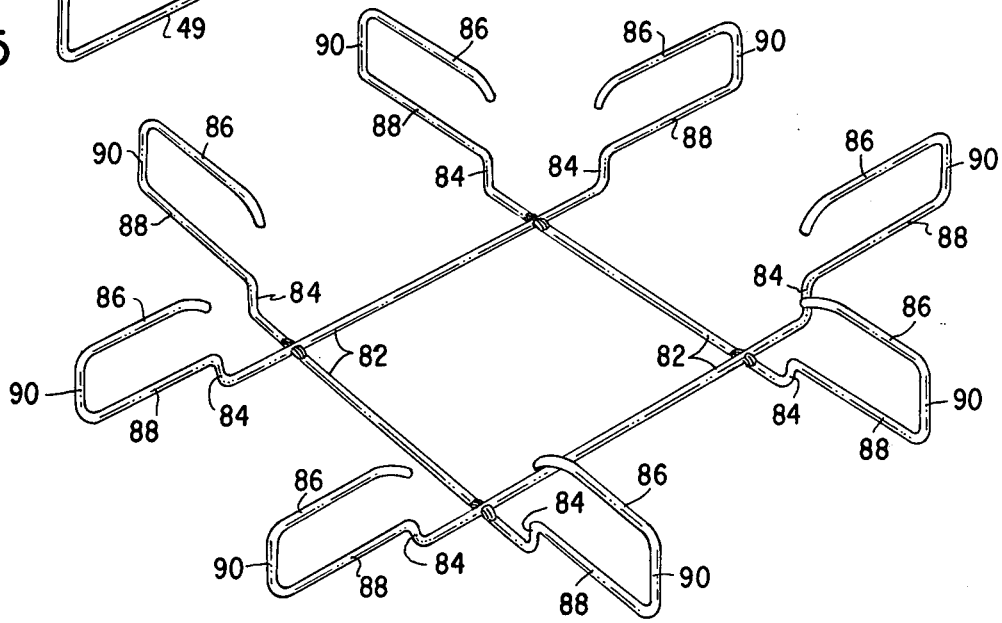
FIG. 7 is a perspective view of the display item support grid utilized in the embodiment shown in FIG. 5.
Figure 6:
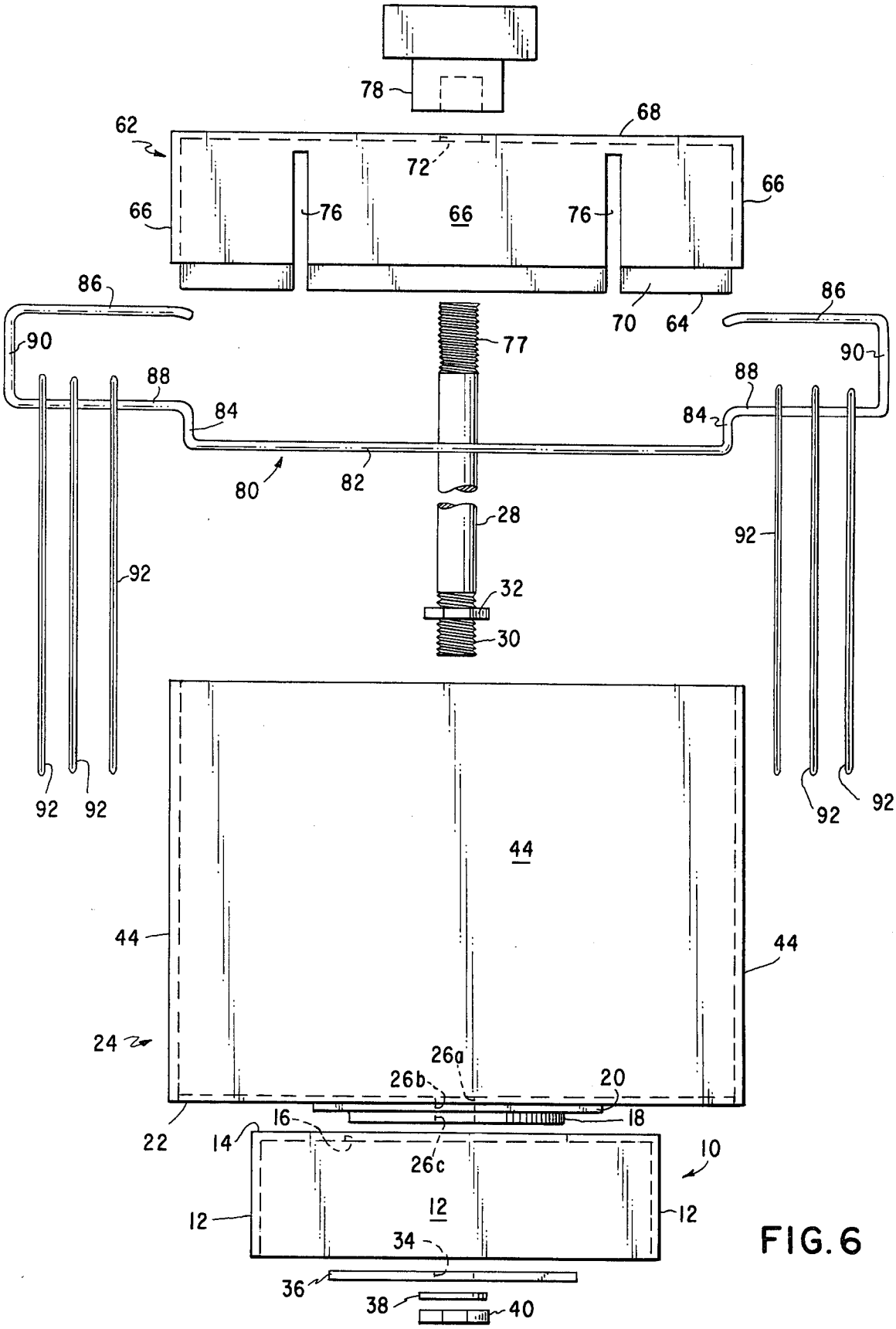
FIG. 6 is an exploded elevational view of a second embodiment of the display device shown in FIG. 1 with the front support rods and depending items to be displayed removed for clarity.

The embodiment shown in FIG. 6 is identical to the embodiment shown in FIG. 2 except that a display item support grid 80 replaces the support rods 46 and mounting panel 56. For purposes of illustration, the display frame 24 as shown in FIGS. 1 and 6 has four side panels 44. With a display frame with this number of panels, the display grid 80 may be constructed with four rods 82 as shown in FIG. 7. Two rods are placed across the other two rods and affixed to one another at the crossover points as by soldering. The ends of the rods 82 are each bent upwardly to form leg 84. The rods 82 are bent to form a horizontally extending generally "U" shaped support rod having upper and lower legs 86 and 88 respectively and an intermediate leg 90 connecting legs 86 and 88. During assembly of this display device, the grid 80 is placed over display frame 24 so that the leg 84 abuts the inner surface of side panels 44 and the lower leg 88 rests on the upper edge of side panels 44. In all other respects, the embodiment is the same as the embodiment shown in FIG. 2.

Figure 8:
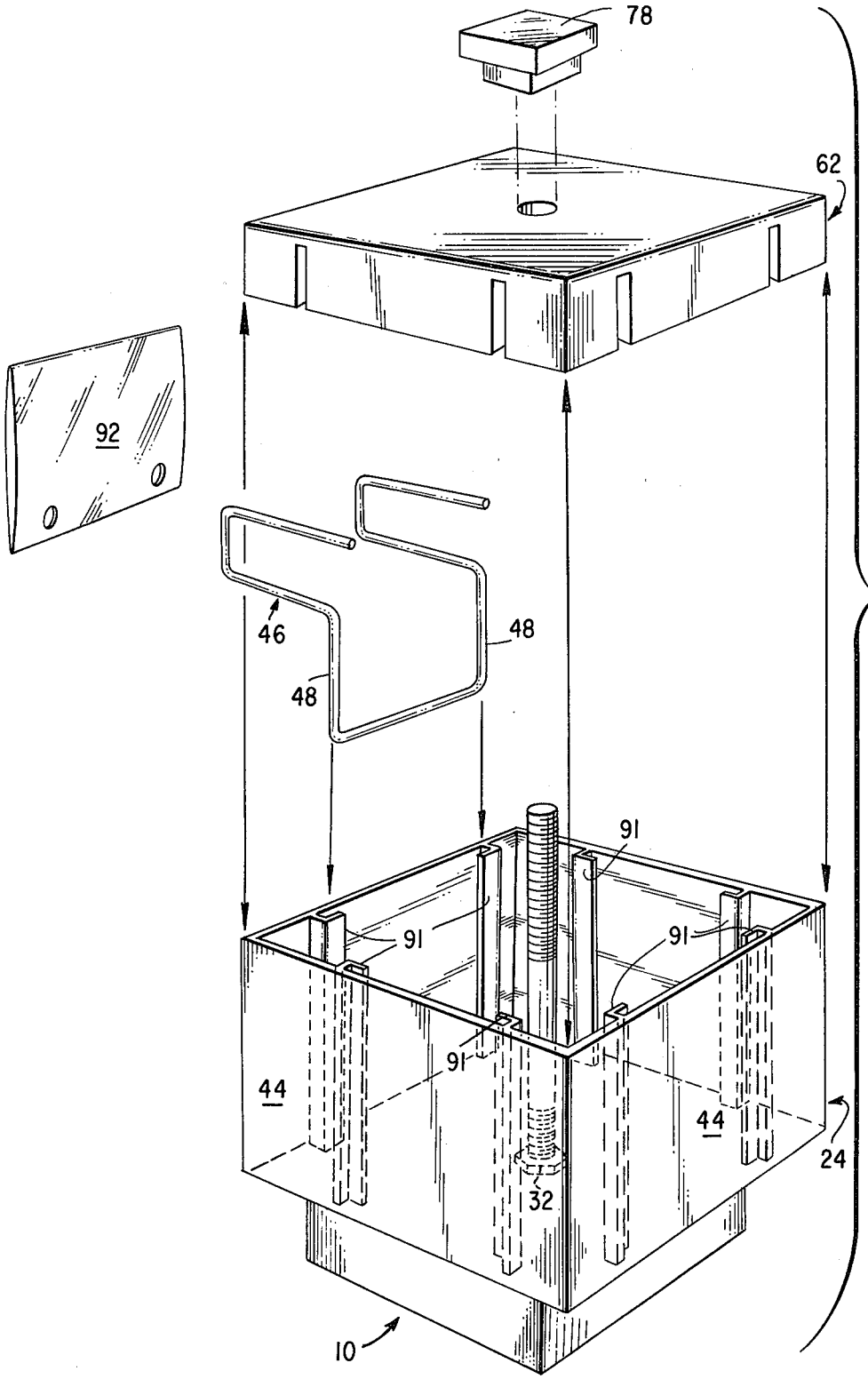
FIG. 8 is a perspective partially exploded view of a preferred embodiment of a display device according to the present invention with portions broken away for clarity.

A preferred embodiment of the present invention is shown in FIG. 8. This embodiment is identical to the embodiment shown in FIGS. 2 expect that the support rods 46 are supported by a pair of "L" shaped channel members 91 mounted to each of the side panels 44 of display frame 24. The channel members 91 of a pair located on a single side panel 44 face and open toward each other as shown in FIG. 8. The channel member 91 receive the depending legs 48 of support rods 46 and thereby secure the support rods 46 in the proper position. In all other respects, the embodiment shown in FIG. 8 is the same as the embodiment shown in FIG. 2. A particular advantage of the embodiment shown in FIG. 8, however, is that each support rod 46 may be removed individually from the display frame 24 without disturbing the others.

With any of the embodiments described above, display items may be mounted on the support rod in a depending relation. For example, the display items may be glassine envelopes 92 as shown in FIGS. 1, 2, 6 and 8. Photographs may then be inserted in these envelopes in a back to back relation. The envelopes have holes 94 punched along one edge for receiving the support rods. These envelopes hang in depending relation from the lower legs of the "U" shaped support rods to expose for view the photograph inserted adjacent the front panel of the envelope. This envelope may then be flipped upwardly to expose both the photograph inserted adjacent the rear panel of the envelope being flipped upwardly and the photograph inserted adjacent the front panel of the envelope next behind the envelope being flipped upwardly. The top cover 62 is preferably constructed so that the edge formed by top wall 68 and side walls 66 support the envelopes, which are flipped upwardly, in a generally upright position.

The present invention provides a versatile carousel type display device where a user can rotate the display frame about a vertical axis to bring into viewing position a selected group of items to be viewed. The user may then flip through this group of items to view the selected item of interest. With items such as photographs held in envelopes, this display device enables a user to display many photographs in little space. Further, the photographs may be arranged on the display frame in any desirable sequence. The photographs are protected from damage yet available for instant viewing.

While the fundamental novel features of the invention have been shown and described, it should be understood that various substitutions, modifications and variations may be made by those skilled in the art without departing from the spirit or scope of the invention. Accordingly, all such modifications and variations are included in the scope of the invention as defined by the following claims.

I claim:

1. A display device for displaying selected items comprising:

a base;

an upright standard being mounted to and supported by the base;

a display frame having multiple side panels and mounted on the standard for rotation about a vertical axis;

support rod means for supporting the selected items to be displayed, the support rods having a generally "U" shaped portion with opposing legs and an intermediate leg connecting the opposing legs; and means for mounting the "U" shaped portion of a support rod to a side panel such that the "U" shaped portion extends away from the display frame and the intermediate leg is disposed in spaced apart relation from the side panel to which the support rod is mounted.

2. A display device according to claim 1 further including means for slidably supporting an item to be displayed on the support rods.

3. A display device according to claim 1 wherein the opposing legs are disposed generally horizontally and the intermediate leg is disposed generally vertically.

4. A display device for displaying selected items comprising:

a base;

an upright standard being mounted to and supported by the base;

an open top display frame having multiple connected side panels defining an interior space and being mounted on the standard for rotation about a vertical axis;

a support rod for supporting the selected items to be displayed, the support rod having a pair of "U" shaped portions, each "U" shaped portion having opposing legs and an intermediate leg connecting the opposing legs together with a depending leg depending from one of the opposing legs, the "U" shaped portions of each pair being disposed in parallel spaced relation and connected by a connecting leg affixed to each of the depending legs; and a pair of channel means mounted to a side panel for receiving the depending legs of a support rod and securing the depending legs to the display frame;

the "U" shaped portions of the support rod disposed in extending relation away from the display frame with the opposing legs of the "U" shaped portions from which the depending legs depend resting on and being supported by the top edge of the display frame and with the intermediate legs spaced from the display frame.

5. The display device according to claim 4 wherein the opposing legs are disposed generally horizontally and the intermediate legs are disposed generally vertically.

6. A display device for displaying selected items comprising:

a base;

an upright standard being mounted to and supported by the base;

an open top display frame having multiple connected side panels defining an interior space and being mounted on the standard for rotation about a vertical axis;

a support rod for supporting the selected items to be displayed, the support rod having a pair of "U" shaped portions, each "U" shaped portion having opposing legs and an intermediate leg connecting the opposing legs together with a depending leg depending from one of the opposing legs, the "U" shaped portions of each pair being disposed in parallel spaced apart relation and connected by a connecting leg affixed to each of the depending legs; and a mounting panel means adapted to be disposed in a generally horizontal plane within the interior space for securing the depending legs of a support rod in abutting relation with the inner surface of a side panel;

the "U" shaped portions of the support rod disposed in extending relation away from the display frame with the opposing legs of the "U" shaped portions from which the depending legs depend resting on and being supported by the top edge of the display frame and with the intermediate legs spaced from the display frame.

7. The display device according to claim 6 wherein the opposing legs are disposed generally horizontally and the intermediate legs are disposed generally vertically.

8. A display device for displaying selected items comprising:

a base;

an upright standard being mounted to and supported by the base;

an open top display frame having multiple connected side panels and being mounted on the standard for rotation about a vertical axis;

a display item support grid for supporting the selected items to be displayed, the grid resting on and supported by the top edge of the display frame and including "U" shaped portions having opposing legs and an intermediate leg connecting the opposing legs;

the "U" shaped portions being disposed in extending relation away from the display frame with the intermediate legs spaced from the display frame.

9. The display device according to claim 8 wherein the opposing legs are disposed generally horizontally and the intermeidate legs are disposed generally vertically.

* * * * *